United States Patent [19]

Combes et al.

[11] Patent Number: 4,576,512

[45] Date of Patent: Mar. 18, 1986

[54] ROTARY SLUICE GATE

[75] Inventors: Gilles Combes, Grenoble; Germain Delage, Montbonnot, both of France

[73] Assignee: Alsthom-Atlantique, Paris, France

[21] Appl. No.: 625,477

[22] Filed: Jun. 28, 1984

[30] Foreign Application Priority Data

Jul. 4, 1983 [FR] France ..... 83 11086

[51] Int. Cl.[4] ..... E02B 7/40

[52] U.S. Cl. ..... 405/100; 405/99; 405/80; 405/87

[58] Field of Search ..... 405/80, 87, 97–100, 405/36, 37, 38, 52

[56] References Cited

U.S. PATENT DOCUMENTS 1,176,390 3/1916 Mercer ..... 405/100

FOREIGN PATENT DOCUMENTS 691481 5/1940 Fed. Rep. of Germany ..... 405/100

*Primary Examiner*—Dennis L. Taylor

*Attorney, Agent, or Firm*—Sughrue, Mion, Zinn, Macpeak & Seas

[57] ABSTRACT

A sluice gate is provided in the form of a vane wheel on a horizontal shaft mounted transversally across the sluice in which it is installed, said vanes being distributed about the shaft and being partially immersible for the purpose of gate operation, same said vanes providing different sluice closing surface areas and said sluice gate comprising wheel locking means to maintain the vanes fixedly in the sluice. Application in small irrigation sluices is suggested.

9 Claims, 10 Drawing Figures

ROTARY SLUICE GATE

This invention relates to sluice gates for controlling the flow through individual sluices wherein they are installed and specifically relates to small irrigation sluice gates together feeding to a tract of land to be irrigated a flow, able to meet contracted specifications, such that said flow is distributed among different sections of said tract.

BACKGROUND OF THE INVENTION

Such gates are installed in small sluices formed, for example, between a canal, termed a feeder or apportioning canal, and a plurality of distribution canals serving the various sections of the tract which are to be irrigated in succession or in groups of sections, whether sequentially layed out or not, at the farmer's discretion.

The means classically provided in the prior art for the purpose of distributing irrigation water are "trap door" type devices which are raised or lowered by hand to open or close the sluices, or compact, flat sector gates similarly operated by hand to yield a maximum flow or a null or nearly-null flow through the sluices. Large sector gates are motor-driven and in some, rare cases are controlled by automatic means.

For the purposes mentioned previously hereinabove, small gates can be driven by motors or servomotors. However, the power required to drive each of the gates means that a power line must be installed alongside the feeder canal.

The object of the present invention is to provide a compact sluice gate having a particularly simple and rugged structure, the individual opening and closing whereof is done by means not requiring any sort of power line to be installed in the installation or works of which it is comprised and which requires no special adjustment or maintenance.

SUMMARY OF THE INVENTION

Accordingly, the invention provides a rotary sluice gate for controlling flow through the canal sluice in which it is installed, said gate being in the form of a vane wheel having a horizontal shaft mounted transversely across the sluice, said wheel having at least three radial vanes distributed about said shaft, said vanes circumferntially being partially and sequentially immersible for operating the gate using the hydraulic energy of the canal and establishing within the sluice different closing surface areas, said sluice gate further including gate locking means successively maintaining at least two of said vanes fixedly in the sluice.

A remote control for such sluice gates defining the time each gate is maintained in sluice opening and closing position, in order to ensure correct operation of the installation as a whole, requires only the transmission of a control signal for the locking means.

Another feature of the invention is that at least one of the vanes, termed the sealing plate, consists of a solid, flat plate having a contour adapted to the contour of the sluice such that it will entirely prevent flow.

In the preferred embodiment of the invention, the sluice gate is provided with four vanes, arranged in opposite pairs, with one of their ends attached to said shaft.

In another embodiment of the invention, at least one of the vanes other than the sealing plate is a curved vane consisting of a solid plate the end opposite the shaft whereof elbows out toward the upstream side of the sluice when said curved vane, termed flow limiting mask, is maintained in the sluice and said sluice is provided with a humped sill.

These features and advantages of the invention, as well as other features and advantages will be more readily apparent in reading the following description and with reference to the drawings of various suggested embodiments.

DESCRIPTION OF THE PREFERRED EMBODIMENTS

Figure 1:
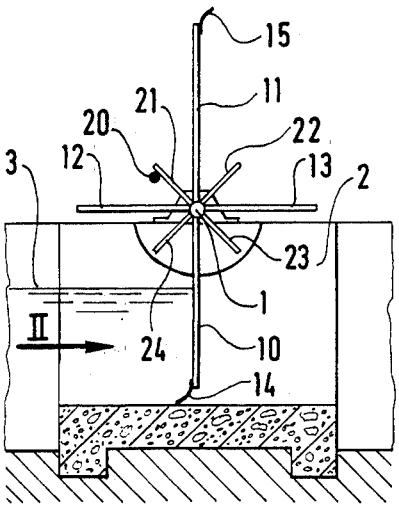
FIG. 1 is a cross-sectional diagram of a sluice gate according to the invention operating on an "ON/OFF" basis by quarter rotations.

As the figures show, the sluice gate according to the invention consists of a radial vane wheel with vanes distributed circumferentially about a horizontal shaft 1 to which they are mounted. Said horizontal shaft 1 is arranged transversely across a sluice 2 wherein it is installed, above the water level upstream from the sluice, designated by 3. The shaft is rotatably freely mounted in two bearings 4 and 5 supported opposite one another by the side walls 6 and 7 of the frame bounding the sluice, as shown in the elevations of FIGS. 2, 4, 6A and 6C.

The sluice 2 receiving said sluice gate is a small sluice having a cross section of less than 1 $m^2$. It is shown to have a square cross section, preferably measuring 0.3 m to 0.5 m on a side, but could alternatively be given a rectangular, trapezoidal, semicircular or elliptical section.

The vanes carried by the horizontal shaft 1 are unequally dimensioned relative to one another. Nevertheless, all must be large enough to be able to be partially immersed in sequence, so that they can receive the thrust of the water in the sluice and thus directly operate the rotary gate using only the available hydraulic energy.

The "ON/OFF" gate, ie. enabling either virtually maximum flow or null, or virtually null flow through the sluice, includes at least one vane consisting of a solid plate shaped and sized to mate with the sluice bed and walls such that it is operable on the one hand to seal off the sluice and on the other hand, together with the other, smaller vanes, to drive the rotary gate. This goes for all gates according to the invention providing several specified flow rates one of which is null or virtually null. Said solid plate operable to close the sluice is called the sealing plate.

The gate thus actuated directly by the available hydraulic energy alone is provided with a lock for locking the gate in its different possible positions.

Figure 2:
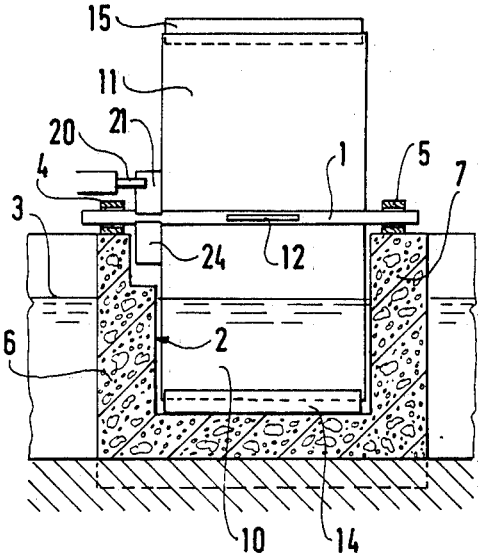
FIG. 2 is a front elevation taken along arrow II of FIG. 1, of the sluice gate depicted in FIG. 1.

In FIGS. 1 and 2, the vane wheel shown on the horizontal shaft 1 has four vanes, two of which 10 and 11 each form a sealing plate. The other two vanes 12 and 13 also consist of solid plates, with however a much smaller surface area, serving merely as operating blades for said gate and both equally allowing maximum flow through the sluice gate. Said four vanes 10 to 13 are arranged 90° apart from one another around the horizontal shaft 1 and are each mounted thereto via one of their edges. The two sealing plates 10 and 11 are mounted opposite one another along the length of the shaft, said length being substantially the same as the width of the sluice 2. Similarly, the operating blades 12 and 13 are located opposite one another in the middle of the horizontal shaft; said blades are substantially narrower than the sluice and substantially shorter than the depth of the sluice.

The sealing plates 10 and 11 are each provided, on their far ends from the shaft 1, with a resilient gasket 14 or 15, according to the plate being considered, made for example of rubber, which applies against the bottom of the sluice when the plate to which it is fitted is in sluice closing position. Said gaskets ensure better sealing of the sluice.

Said sealing plates 10 and 11 may also be provided, on each of their contiguous edges to the shaft 1, with similar resilient gaskets providing improved water tight sealing along the sluice side walls.

The lock serving to lock the sluice gate successively in its sluice closing and sluice opening positions is of a type blocking the vane wheel at each quarter turn of the shaft. It is represented by an assembly comprising a retractable indexing rod 20 and a set of four fins 21 to 24 mounted to said same horizontal shaft 1, near one of its ends, each of said fins being operable to arrestably hit the bar when the latter is set forward. Said fins are arranged at 90° angles to one another and are angularly offset in relation to the vanes with respect to the indexing rod such as to lock the wheel whenever one of the vanes is vertically positioned in the sluice. When said rod is retracted, then returned to operable position following a suitably timed delay, said fins are allowed to rotate, then are blocked at the end of a quarter turn, thus locking the wheel and producing the alternating ON and OFF operation of the sluice gate.

Figure 3:
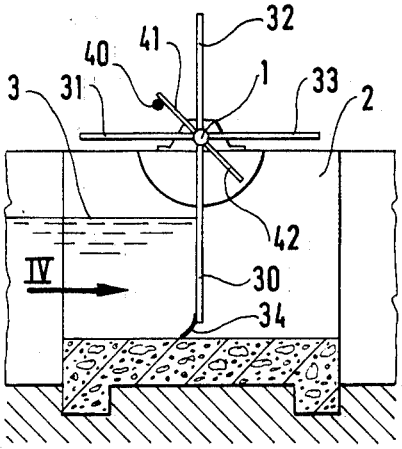
FIG. 3 is a cross-sectional diagram of a first alternative embodiment of the sluice gate according to the invention, similarly operated on an "ON/OFF" basis, except in half-rotational steps.
Figure 4:
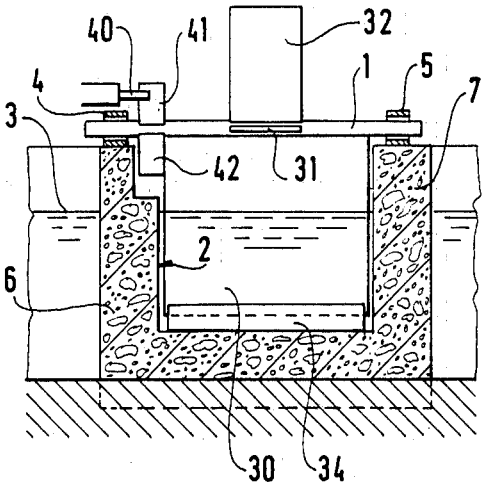
FIG. 4 is a front elevation taken along arrow IV of FIG. 3, of the sluice gate depicted in FIG. 3.
Figure 5:
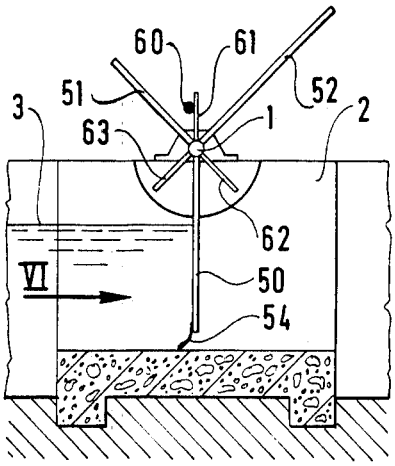
FIG. 5 is a cross-sectional diagram of a second alternative embodiment of the sluice gate according to the invention, also operable on an "ON/OFF" basis, but additionally providing a given intermediate flow.

In the first alternative embodiment depicted in FIGS. 3 and 4, the vane wheel defined on the horizontal shaft 1 comprises four vanes similarly arranged at 90° angles from one another about the shaft, but only one of said vanes, ie. the one labelled 30, is a sluice sealing plate. Said latter vane is identical to said previously mentioned plate 10 of FIGS. 1 and 2, similarly has a resilient gasket 34 on its opposite end from the horizontal shaft and can further be provided with two similar gaskets on its shaft-contiguous edges. The three remaining vanes 31, 32 and 33 are identical to one another and to vanes 12 and 13 mentioned previously with reference to FIGS. 1 and 2 and are merely gate operating blades.

More than three such operating blades can be provided, as long as one of them is arranged opposite the sealing plate 30.

The locking device stopping the rotary sluice gate in both its sluice opening and closing positions is of a type blocking rotation in half-rotational steps. It is depicted as consisting of an assembly comprising a retractable indexing rod 40 and a set ot two fins 41 arranged opposite one another about the horizontal shaft 1, near one of the ends of said shaft. Said fins are driven with the shaft when the indexing rod is retracted, thus successively hitting said rod when it is reset, and providing the "ON/OFF" operation of the sluice gate which is blocked at each half rotation of the revolving assembly. The location of said rod, with which the two fins cooperate, defines the angular arrangement of said fins on the shaft 1 in such manner as to maintain the sealing plate 30 or the operating blade 32 fixedly in vertical position in the sluice.

Figure 6A:
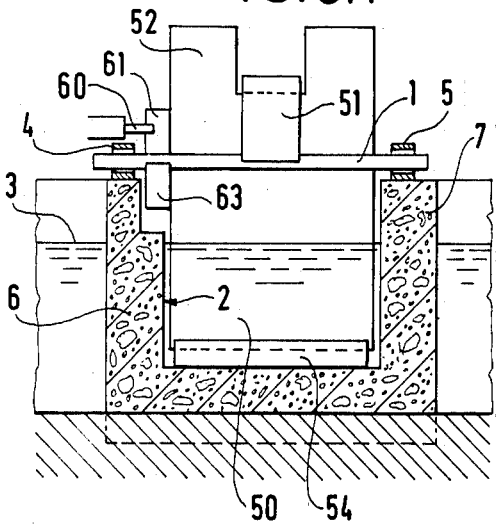
FIGS. 6A, 6B and 6C are front elevations of the gate according to said second alternative embodiment, taken along arrow VI of FIG. 5, showing the different positions the rotary gate may assume to deliver respectively a null flow, a maximum flow or an intermediate flow.
Figure 6B:
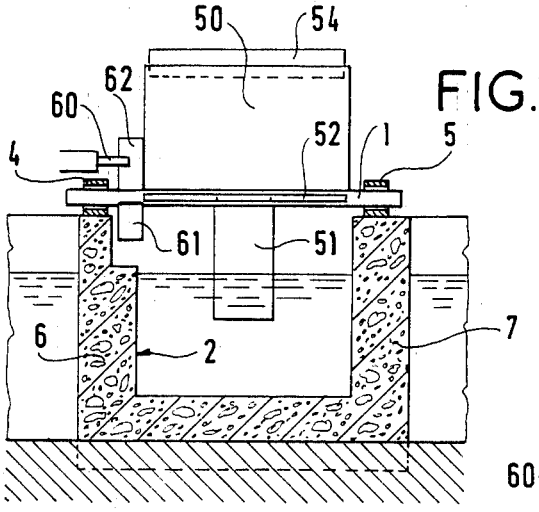
Figure 6C:
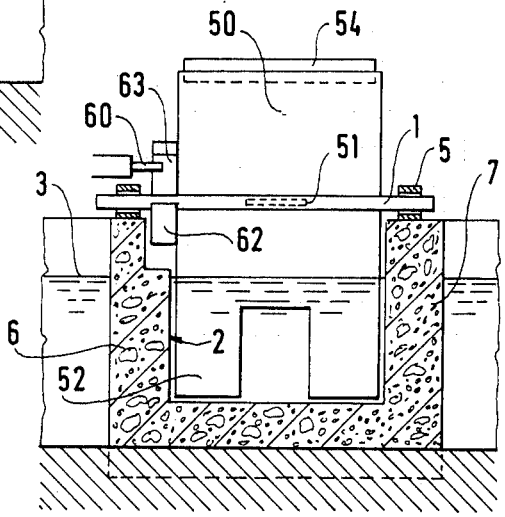

In the second alternative embodiment depicted in FIGS. 5 and 6A through 6C, the vane wheel defined on the horizontal shaft 1 comprises three vanes arranged at 120° angles from one another about the shaft. One of said vanes, designated by the number 50, is a sluice 2 sealing plate (FIG. 6A). This plate is identical to the previously mentioned plate 10 and similarly has a resilient gasket 54 on its opposite end from the horizontal shaft and can further be provided with two similar gaskets on its shaft-contiguous edges. One of the two remaining vanes, bearing the reference 51, is identical to vanes 12 and 13 of the sluice gate shown in FIGS. 1 and 2, serving merely as an operating blade allowing maximum flow through the sluice 2 (FIG. 6B). The third said vane 52 consists of a solid plate shaped substantially to mate with the internal contour of the sluice, but having a cutout 53 in its opposite end from said shaft 1. Said third vane 52, like the two previously mentioned vanes 50 and 51, serves to operate the sluice gate and enables delivery, as shown in FIG. 6C, of an intermediate flow, as defined by design, through the sluice 2.

The latter sluice gate with its three vanes 50, 51 and 52 makes it possible to adjust the flow successively to three different values, one of which is virtually null.

The same gate can further be provided with a fourth vane, different from the other three 50 to 52, to adjust flow successively to four different values, one of which is virtually null.

The locking device for the gate shown in FIGS. 5 and 6A through 6C is designed to stop the vane wheel at each third of a rotation of said wheel. It is represented by an assembly comprising a retractable indexing rod 60 and a set of three fins 61, 62 and 63 operable to arrestably hit the rod when it is extended, said fins being arranged at 120° angles from one another about the horizontal shaft near an end whereto they are attached. Said fins are angularly offset in relation to the vanes 50 to 52 and according to the location of the indexing rod such as to cause said vanes to be successively locked in vertical position in the sluice. As each vane 50 through 52 comes successively to rest in said just-mentioned vertical position in the course of one revolution of the wheel and is maintained therein by said locking means, the following sequence of flows is obtained, as shown in FIGS. 6A, 6B and 6C:

a shutoff of flow, when plate 50 closes the sluice, a maximum flow through the sluice 2 which the gate operating blade 51 leaves virtually wide open, a medium flow through the sluice 2 when it is partly closed by plate 52.

Alternatively, the no-flow phase can be eliminated and replaced with a non-null or nearly null flow by substituting for the sealing plate 50 a plate providing only partial closure of the sluice.

Figure 7A:
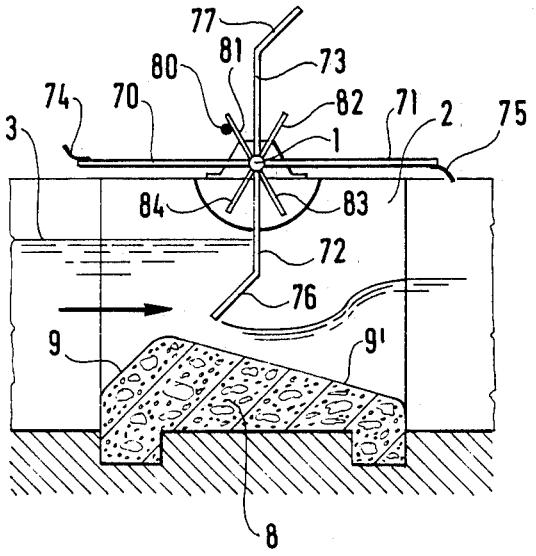
FIGS. 7A and 7B are two cross-sectional views of a third alternative embodiment of the sluice gate according to the invention also operated on an "ON/OFF" basis in quarter-rotational steps, but providing a virtually constant maximum flow regardless of variations in the impounded load, showing the OPEN and CLOSED positions respectively.
Figure 7B:
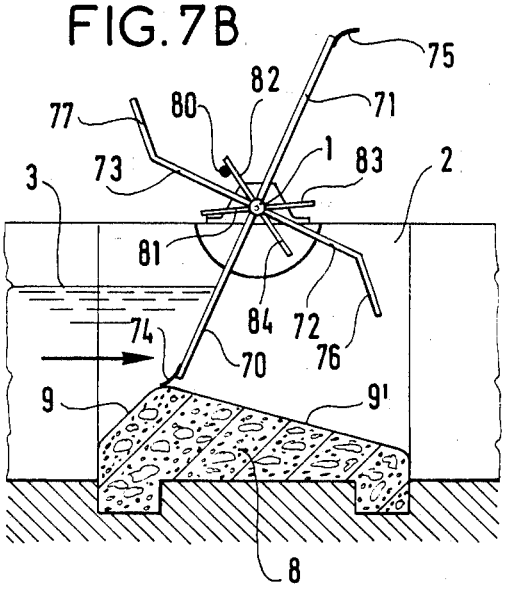

In the third alternative embodiment depicted in FIGS. 7A and 7B, the vane wheel defined on the horizontal shaft 1 comprises four vanes arranged at 90° angles from one another, two of which, bearing the references 70 and 71, each form a sluice 2 sealing plate. Said latter vanes 70 and 71 are identical to the previously-mentioned plate 10 of FIGS. 1 and 2 and are similarly provided with a resilient gasket, 74 and 75 respectively, on their ends opposite the horizontal shaft and optionally on their lateral edges.

The two remaining vanes 72 and 73, opposite one another across the shaft 1 and identical to one another, also called flow limiting masks, consist of curved vanes the outside ends of the plates whereof are bent parallel to the horizontal shaft 1, forming baffles, 76 and 77 respectively, elbowed toward upstream when said mask dips vertically into the sluice.

Said vanes 70 through 73 in particular serve to operate the rotary gate using the available hydraulic energy.

The sluice 2 associated with said latter sluice gate is provided with a sill having a short, steep upstream slope 9 and a longer, gentler downstream slope 9'.

Vane 70 or 71, when held fixedly atop the peak of sill 8, closes the sluice as shown in FIG. 7B. The mask, 72 or 73, on the other hand, when it is held fixedly above the sill with its baffle section removed from said sill as shown in FIG. 7A, and behind the peak of the sill, enables delivery of a substantially constant flow, regardless of the upstream water level.

It is therefore apparent that such a rotary sluice gate with flow limiting masks can be substituted in the place of fixed-mask devices known in the prior art which require, for purposes of interrupting flow, the working of a smaller, auxiliary valve located in front or behind the mask.

The locking device for securing this sluice gate in its closed and open positions is of a type locking said wheel successively in the two positions just mentioned at every half-rotation, according to which one of the sealing plates 70, 71 is stationed atop the peak of the sill and the following mask 72 or 73 is stationed slightly above the peak of the sill. This lock is represented as in the foregoing cases by an assembly comprising a retractable indexing rod 80 and a set of four fins 81 through 84 fitted in opposite pairs to the horizontal shaft 1, close to one of the ends thereof.

In this embodiment, the rotational angles required to go from full closure to opening with a constant flow or vice-versa depend on the geometry of the limiting mask and of the shaped sill with which it cooperates. Said angles therefore differ according to the design of the specific mask used. In any case, however, they define the relative angular position of the fins on the shaft.

The locking device maintaining the rotary gate in closed or opened position, or in its various successive positions, in all of the various embodiments mentioned herein is controlled either locally, via a timing switch, or remotely. Said control keeps the lock engaged during successive, specified time periods separated from one another by short intervals during which the lock is disengaged to allow the gate's switching from one position to another by rotation of the vane wheel.

This invention has been described in terms of several selected embodiments which have been given as examples and illustrated in the appended drawings. It will occur to those skilled in the art that a number of further modifications and/or the replacement of some of the means mentioned by other, technically equivalent means may be envisaged, which should not be construed as limiting the scope of the invention. For example, the locking means for the rotary gate serving to secure said gate against rotation could consist merely of a retractable indexing rod alone, engaging when extended, directly with the vanes providing gate operation and flow control. In this case, each of the vanes would consist of a plate having a contour adapted to the internal contour of the sluice and being provided with a center cutout in their outside ends sized according to their function of either partially or fully opening the sluice. Alternatively, keeping the locking means as depicted in the figures, ie. such as not to engage directly with the sluicing and operating vanes, said vanes may themselves be modified and consist of solid plates having a contour matching the shape of the sluice with cutouts of different sizes according to their function.

Another possible alternative within the scope and spirit of the invention would be to provide, instead of the above-described locking means with a single retractable rod, a plurality of indexing rods assigned individually to the various possible flow rates obtainable with the gate, or even a single rod operable to take a plurality of positions each corresponding to a different flow rate. In the latter two cases, the fins must be variably offset with respect to the end of the shaft so that only the suitable fin or fins for the required mode of flow are engageable by the "selected" indexing rod or the single rod in a chosen position to secure the wheel against rotation. Accordingly, in the specific case of an "ON/OFF" sluice gate, the locking means can comprise either two indexing rods or a single, two-position rod for securing the gate in either the open or closed position.

We claim:

1. A rotary sluice gate for controlling the flow through a canal sluice wherein it is installed, said gate consisting of a vane wheel, said wheel including a horizontal shaft mounted transversely across the top of the sluice for rotation about its axis, said wheel having at least three radial vanes fixed about said shaft at circumferential positions, said vanes being of a length so as to be partially and sequentially immersible for operating the gate using the hydraulic energy of the canal for rotating said wheel and means for establishing within the sluice different closing surface areas, and said sluice gate including gate locking means for successively maintaining said wheel at positions where at least two of said vanes are fixedly immersed in the canal sluice.

2. A rotary sluice gate as claimed in claim 1, wherein at least one of said vanes is a solid, flat plate having a contour and size corresponding to the interior of the sluice, such that it can entirely prevent flow, said plate being termed a sealing plate.

3. A rotary sluice gate as in claim 2, wherein said vane wheel is provided with four vanes arranged in opposite pairs about said shaft, with an end of each vane attached lengthwise to said shaft.

4. A rotary sluice gate as in claim 3, wherein two of said vanes, arranged opposite one another across said shaft, comprise sealing plates operable to close the sluice.

5. A rotary sluice gate as in claim 2, wherein said wheel is provided with three vanes each having an end thereof attached lengthwise to said horizontal shaft, said vanes being arranged substantially 120° apart around said shaft.

6. A rotary sluice gate as in claim 5, wherein at least one of the vanes other than the sealing plate is a curved vane consisting of a solid plate, the end furthest from the shaft whereof is bent to form a baffle elbowed toward the upstream side of the sluice when said curved vane, termed a flow limiting mask, is maintained in the sluice, and said sluice is provided with a humped sill.

7. A rotary sluice gate as claimed in claim 6, wherein said at least one sealing plate is provided with a resilient gasket along its outside edge.

8. A rotary sluice gate as in claim 7, wherein said locking means mentioned in claim 1 above includes at least one controlled axially shiftable indexing rod.

9. A rotary sluice gate as claimed in claim 8, wherein the locking means further includes a set of fins mounted to the end of said shaft and said fins being positioned in the path of said axially shiftable indexing rod to yield one of several possible flows.

* * * * *